US005422129A

United States Patent [19]

Draddy

[11] Patent Number: 5,422,129

[45] Date of Patent: Jun. 6, 1995

[54] DISPENSING DISPLAY CONTAINER AND PARTICULATE COFFEE THEREIN

[76] Inventor: John G. Draddy, 2890 Church Hill Dr., Boynton Beach, Fla. 33435

[21] Appl. No.: 225,635

[22] Filed: Apr. 11, 1994

[51] Int. Cl.[6] ..... B65D 21/08

[52] U.S. Cl. ..... 426/115; 426/106; 426/111; 426/131; 220/4.26; 215/10; 215/386

[58] Field of Search ..... 426/115, 131, 111, 106; 215/100 R, 10, 6; 220/4.26, 4.27

[56] References Cited

U.S. PATENT DOCUMENTS

| | | | |
|---|---|---|---|
| 475,231 | 5/1892 | Anderson | 220/4.26 |
| 880,082 | 2/1908 | Kendrick | 215/6 |
| 1,434,460 | 11/1922 | Tibbatts | 220/4.26 |
| 2,092,772 | 9/1937 | Nadelson | 426/115 |
| 2,326,414 | 8/1943 | Thompson | 220/4.26 |
| 2,562,496 | 7/1951 | Kirsch | 215/100 R |
| 2,726,012 | 12/1955 | Jensen | 426/131 |
| 2,972,407 | 2/1961 | Taylor | 220/4.26 |
| 3,144,152 | 8/1964 | Kopp | 426/115 |
| 3,156,272 | 11/1964 | Indrunas | 215/100 R |
| 3,380,624 | 4/1968 | Lincoln et al. | 426/131 |
| 3,615,150 | 10/1971 | Indrunas | 215/100 R |
| 3,719,306 | 3/1973 | Holtzman | 426/115 |
| 3,874,429 | 4/1975 | Lafarge | 215/100 R |
| 3,945,617 | 3/1976 | Callery | 215/100 R |
| 3,967,773 | 7/1976 | Kaufman | 426/130 |
| 4,091,929 | 5/1978 | Krane | 426/130 |
| 4,336,891 | 6/1982 | Smith | 215/100 R |
| 4,598,832 | 7/1986 | Alonso | 215/6 |
| 4,603,784 | 8/1986 | Chang | 215/10 |
| 4,703,863 | 11/1987 | Kohus | 215/11.1 |
| 4,778,068 | 10/1988 | Kohus | 215/11.1 |

*Primary Examiner*—Steven Weinstein
*Attorney, Agent, or Firm*—Victor F. Volk

[57] ABSTRACT

A dispensing display container of coffee or other spoonable particulate foodstuff comprises an upper, externally threaded cylinder and an internally threaded sleeve that the user discards when empty.

3 Claims, 1 Drawing Sheet

DISPENSING DISPLAY CONTAINER AND PARTICULATE COFFEE THEREIN

BACKGROUND OF THE INVENTION

Containers or packages for consumer foodstuffs must serve two, sometimes conflicting, purposes: storage and display of the product in the store shelves, and dispensing of the foodstuff at the home where people will use it. A tall and narrow container or package makes a more visible display than a short, broad, one and it also makes more efficient use of the storage space, since the upper area of the shelf might otherwise have gone unutilized. This applies at home as well as in the store, not only on closet shelves but in refrigerators, with particular reference to refrigerator door space. Tall, narrow containers, however, present a particular problem for dispensing spoonable foodstuffs in particulate form, such as powdered instant coffee and other beverages, creamer, etc., which the consumer will dispense with a teaspoon. Successful dispensing often requires expert manipulation of the spoon to get it half-full, even, heaping, etc., and becomes awkward or impossible if a narrow container has too much depth.

Tall containers, efficient for storage, and for making economical purchases, also have the disadvantage of changing the flavor of their contents by long exposures to large volumes of moisture-laden air trapped in half-empty packages.

U.S. Pat. No. 2,645,375, to Topfer describes a sectionalized lipstick container in which the containing elements thread onto each other and one discards them as the lipstick shortens. But there exist no means exclusively for making connection and the contents make contact with each of the elements in the combined container. U.S. Pat. No. 4,444,324, to Grenell describes an insulated two-part container joined by mean of an internal cylinder threaded on its outer surface, so that it, too, has contact with the container contents. We know that flavor-sensitive foods, such as coffee, often use glass containers to maintain a preferred taste, or because customers so believe.

SUMMARY OF THE INVENTION

I have invented a container, substantially full of particulate foodstuff, such as instant coffee, that comprises a lower bottom chamber, preferably glass, with an integral bottom closure and an open, externally threaded top portion. A short, cylindrical sleeve with upper and lower internal threads tightly engages the top portion of this chamber. My container also comprises an open-ended cylindrical chamber, also preferably glass, with externally threaded portions at both ends, with one of these portions closely engaging the upper internal threads of the sleeve. My invention also includes a threaded cover that fits tightly over the cylinder, and a quantity of a particulate, spoonable foodstuff, such as coffee.

The depth of the cylinder does not exceed that from which one can accurately measure out the contents with a teaspoon and when one empties the cylinder he removes it, and the connecting sleeve, and discards them so that he can fit the cap directly onto the bottom chamber.

DETAILED DESCRIPTION OF A PREFERRED EMBODIMENT

Figure 1:
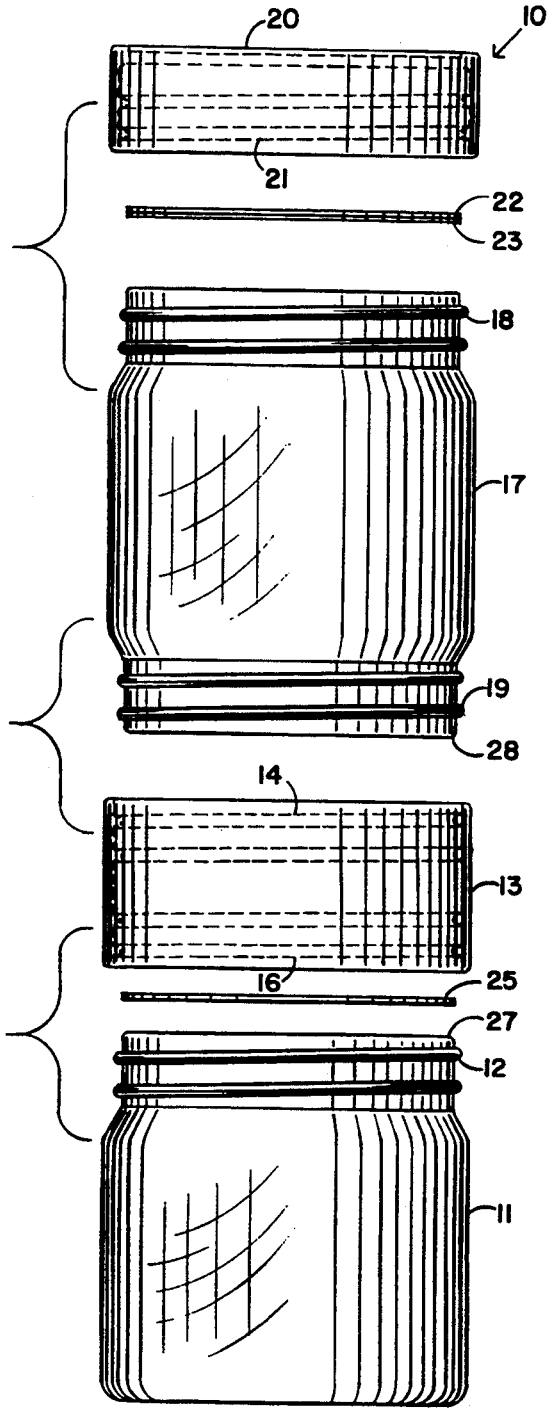
FIG. 1 shows an expanded side elevation of the structural elements of my invention.

Referring first to FIG. 1 a container 10 comprises a glass jar 11 with external threads 12 at its top, and a plastic, internally threaded sleeve 13, comprising upper and lower, oppositely directed, internal thread turns 14, 16. The thread turns 16 fit the threads 12 to give the sleeve 13 a tight fit over the jar 11. A glass cylinder 17 has upper and lower external threads 18, 19 which fit the upper threads 14 of the sleeve 13, and a plastic cover 20 has threads 21 that fit any of the threads 18, 19, or 12. An aluminum film 22 with a ring 23 of adhesive can bond to an upper rim 24 of the cylinder 17. A waxed annular, cardboard gasket 25, that can fit entirely within the sleeve 13 will seal the top of the jar 11 to the bottom of the cylinder 17.

Figure 2:
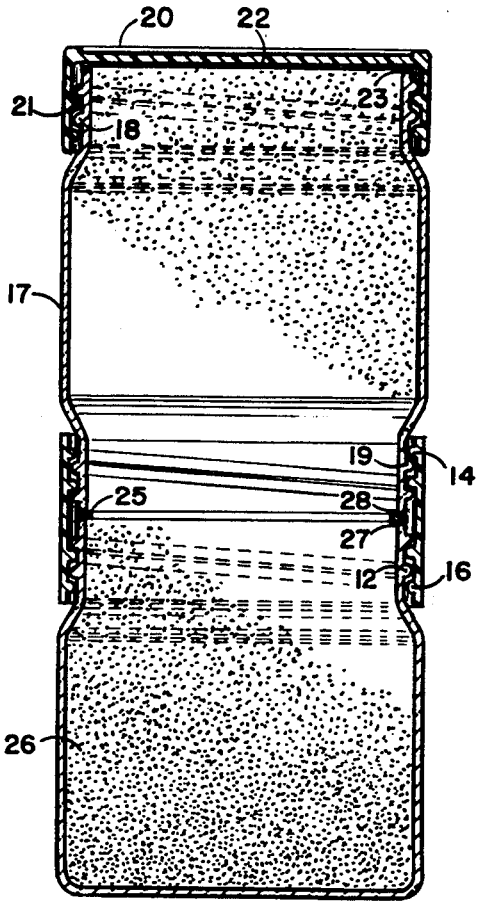
FIG. 2 shows a section through my invention in display mode.

Referring now to FIG. 2 which exhibits the elements of FIG. 1 in section after assembly and filling with particulate coffee 26 the top 27 of the jar 11 and the bottom 28 of the cylinder 17 fit against the gasket 25 so that the coffee 26 has negligible pressure contact, if any, with any material other than the glass of the jar and the container during shelf storage.

The volume of the jar 11 approximately equals the volume of the cylinder 17, the bottom of which a teaspoon will readily reach. After emptying the cylinder one discards the cylinder 17 and sleeve 14 and applies the cover 20 directly to the threads 12 of the jar 11. This has the effect, not only of making it easier to measure out exact spoonful portions but it reduces the quantity of moisturizing and oxidizing air stored in contact with the coffee 26.

Figure 3:
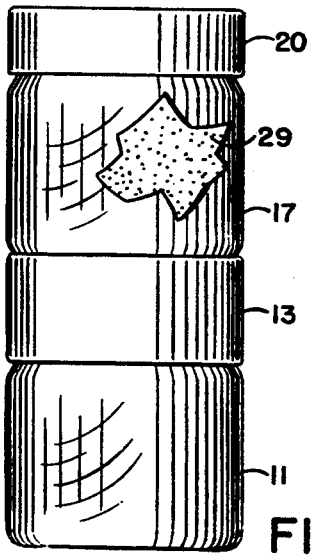
FIG. 3 shows a container of my invention holding powdered coffee creamer.

However, my invention may have application where the jar 11 and the cylinder 17 may comprise known types of plastic since the flavor of the particulate foodstuff used does not react as sensitively as coffee to materials other than glass. In FIG. 3 I have shown my container filled with powdered coffee creamer which, in presently known containers presents particular difficulty in spooning out.

I have made the foregoing description exemplary, rather than definitive, of my invention for which I desire an award of Letters Patent as defined in the appended claims.

I claim:

1. A substantially full, dispensing, display container containing coffee comprising:

(A) a lower cylindrical glass chamber comprising an integral bottom closure and an open, externally threaded, top portion of said chamber, (B) a short, open-ended cylindrical opaque plastic sleeve comprising upper and lower, oppositely directed, internal threads, said lower threads tightly engaging said threaded top portion of said lower chamber, (C) an upper cylindrical glass chamber comprising first and second open ends, said upper chamber further comprising externally threaded portions at each end thereof, the threads of said externally threaded portion at said first end of said upper chamber closely engaging said upper internal threads of said sleeve, said top portion of the lower chamber being at least substantially sealed to the first end of said upper chamber such that coffee in the container has negligible pressure contact with any material other than the glass of the chambers, (D) a threaded opaque plastic cover tightly engaging the threads of said threaded portion of said second end of said upper chamber, (E) a quantity of accurately spoonable, particulate coffee substantially filling said dispensing, display container;

said open ends of said sleeve and said upper chamber and said open top portion of said lower chamber all being dimensioned to allow access by a teaspoon and wherein the depths of neither the lower nor the upper chamber exceed that from which one can accurately measure out the contents with the teaspoon and wherein the cover is engageable on the open, externally threaded top portion of the lower chamber such that when the upper chamber is emptied of coffee, the upper chamber and sleeve can be removed from the container, the coffee in the lower chamber can be accessed by the teaspoon, and the cover can be secured to the lower chamber.

2. The substantially full, dispensing, display container of claim 1 comprising a gasket sealing the first end of said upper, open-ended cylindrical chamber to the top portion of said lower cylindrical chamber.

3. The dispensing, display container of claim 1 wherein said upper and said lower chambers have substantially equal volumes.

* * * * *